US011510512B2

(12) United States Patent
Pinelli et al.

(10) Patent No.: US 11,510,512 B2
(45) Date of Patent: Nov. 29, 2022

(54) SOFT STRAW LID FOR BEVERAGE CONTAINER

(71) Applicant: Leapfrog Product Development LLC, Chicago, IL (US)

(72) Inventors: Steven N. Pinelli, Ogden Dunes, IN (US); Jingyan Wang, Harbin (CN); Glen C. Gilmore, III, Naperville, IL (US); Brian M. Clemens, Burnsville, MN (US); Micaela K. McCabe, Chicago, IL (US); Richard E. Ellison, Chicago, IL (US); Kurtis M. Sward, Anna Maria, FL (US)

(73) Assignee: Leapfrog Product Development LLC, Chicago, IL (US)

( * ) Notice: Subject to any disclaimer, the term of this patent is extended or adjusted under 35 U.S.C. 154(b) by 4 days.

(21) Appl. No.: 17/027,085

(22) Filed: Sep. 21, 2020

(65) Prior Publication Data

US 2021/0085104 A1 Mar. 25, 2021

Related U.S. Application Data

(60) Provisional application No. 62/903,175, filed on Sep. 20, 2019.

(51) Int. Cl.

| | |
|---|---|
| ***A47G 19/22*** | (2006.01) |
| ***B65D 47/32*** | (2006.01) |
| ***B65D 47/08*** | (2006.01) |

(52) U.S. Cl.

CPC ..... *A47G 19/2222* (2013.01); *B65D 47/0871* (2013.01); *B65D 47/32* (2013.01); *B65D 2251/20* (2013.01); *B65D 2547/063* (2013.01)

(58) Field of Classification Search

CPC ..... A47G 19/2222; A47G 19/2205; A47G 19/2266; B65D 47/0871; B65D 47/0861;

(Continued)

(56) References Cited

U.S. PATENT DOCUMENTS 5,203,841 A * 4/1993 Kitabayashi ..... B65D 47/2043 222/530

5,282,541 A * 2/1994 Chen ..... B65D 77/283 220/254.1

(Continued)

FOREIGN PATENT DOCUMENTS

| | | | |
|---|---|---|---|
| WO | 1982000278 | A1 | 2/1982 |
| WO | 2009145847 | A1 | 12/2009 |
| WO | 2011154324 | A1 | 12/2011 |

OTHER PUBLICATIONS

Zulu, "Atlas20 oz Glass Water Bottle," accessed on-line at: https://www.zuluathletic.com/shop-all/atlas-glass-water-bottle (available at least as early as Feb. 22, 2019).

(Continued)

*Primary Examiner* — Robert J Hicks

(74) *Attorney, Agent, or Firm* — Barnes & Thornburg LLP

(57) ABSTRACT

A lid assembly for a beverage container is provided. The lid assembly has a lid base, a mouthpiece and a lid dome. The mouthpiece is connected to the lid base and has a first end having a generally flat surface that is provided at an angle to the top surface of the lid base, a second end adapted to receive a straw, and a drink aperture therethrough. The lid dome is pivotally connected to the lid base and pivots between an open position and a closed position. The lid dome has a protrusion that extends from an inner surface of the lid dome. The protrusion has a seal surface at an angle to the top wall to seal against the first end of the mouthpiece to close the drink aperture when the lid dome is in the closed position.

20 Claims, 5 Drawing Sheets

(58) Field of Classification Search
CPC .... B65D 47/0857; B65D 47/08; B65D 51/24; B65D 51/18
USPC ..... 220/709, 705, 212, 254.3, 254.1, 259.1, 220/256.1, 830, 827, 810, 367.1; 215/229, 228, 388, 387, 307, 245, 244, 215/237
See application file for complete search history.

(56) References Cited

U.S. PATENT DOCUMENTS

| | | | | |
|---|---|---|---|---|
| D364,810 | S | 12/1995 | Meisner | |
| 5,582,320 | A * | 12/1996 | Lin | B65D 47/2043 215/229 |
| 5,884,793 | A * | 3/1999 | Wang | B65D 47/066 220/255 |
| D471,455 | S | 3/2003 | Laveault et al. | |
| 6,609,624 | B2 * | 8/2003 | Goto | A47G 19/2266 220/709 |
| D485,132 | S | 1/2004 | Ohno et al. | |
| D505,294 | S | 5/2005 | Gauss | |
| D508,185 | S | 8/2005 | Gauss | |
| D515,357 | S | 2/2006 | Ward et al. | |
| D528,862 | S | 9/2006 | Li | |
| D533,061 | S | 12/2006 | Li | |
| D564,841 | S | 3/2008 | Clemens et al. | |
| D579,722 | S | 11/2008 | Sakulsacha et al. | |
| D579,772 | S | 11/2008 | Williams | |
| D581,727 | S | 12/2008 | Pinelli et al. | |
| D592,456 | S | 5/2009 | Pinelli et al. | |
| D592,905 | S | 5/2009 | Pinelli et al. | |
| D592,913 | S | 5/2009 | Pinelli et al. | |
| 7,546,933 | B2 | 6/2009 | Pinelli | |
| D609,964 | S | 2/2010 | Lane | |
| 7,861,873 | B1 | 1/2011 | Bragg et al. | |
| D643,249 | S | 8/2011 | Miller et al. | |
| 7,997,442 | B2 | 8/2011 | Pinelli | |
| D655,580 | S | 3/2012 | Kotani | |
| D656,787 | S | 4/2012 | Phillips et al. | |
| D661,945 | S | 6/2012 | Eyal | |
| 8,336,724 | B2 * | 12/2012 | Yamashita | A47G 19/2266 220/254.1 |
| D675,060 | S | 1/2013 | Lane | |
| 8,360,267 | B1 | 1/2013 | Chiou et al. | |
| D686,871 | S | 7/2013 | Lane | |
| 8,550,269 | B2 * | 10/2013 | Lane | B65D 47/0885 215/229 |
| D693,629 | S | 11/2013 | Miller | |
| D693,630 | S | 11/2013 | Hurley et al. | |
| 8,579,133 | B2 | 11/2013 | Marcus et al. | |
| 8,590,731 | B2 | 11/2013 | Pinelli | |
| D700,012 | S | 2/2014 | Hurley et al. | |
| D700,802 | S | 3/2014 | Miller | |
| 8,978,906 | B2 | 3/2015 | Feeley et al. | |
| D725,966 | S | 4/2015 | Boroski et al. | |
| D739,183 | S | 9/2015 | Lane | |
| 9,221,585 | B1 * | 12/2015 | Wang | B65D 47/2037 |
| 9,266,643 | B2 | 2/2016 | Marcus et al. | |
| D758,189 | S | 6/2016 | Roth et al. | |
| D758,790 | S | 6/2016 | Boroski | |
| D780,578 | S | 3/2017 | Lane et al. | |
| D785,402 | S | 5/2017 | Shirley et al. | |
| D793,804 | S | 8/2017 | Herbst et al. | |
| D794,453 | S | 8/2017 | Boroski et al. | |
| D795,011 | S | 8/2017 | Pisarevsky | |
| D799,898 | S | 10/2017 | Yao | |
| D802,993 | S | 11/2017 | Joseph et al. | |
| D804,903 | S | 12/2017 | Mason et al. | |
| D804,904 | S | 12/2017 | Noveletsky et al. | |
| D808,220 | S | 1/2018 | Bums et al. | |
| D809,384 | S | 2/2018 | Best et al. | |
| D814,398 | S | 4/2018 | Yasunaga | |
| D817,713 | S | 5/2018 | Lin | |
| D818,767 | S | 5/2018 | Nezu | |
| D821,136 | S | 6/2018 | Silsby et al. | |
| D821,137 | S | 6/2018 | Boroski | |
| D821,815 | S | 7/2018 | Chung | |
| D822,427 | S | 7/2018 | Sorensen et al. | |
| D831,425 | S | 10/2018 | Best et al. | |
| D831,433 | S | 10/2018 | Fleischhut | |
| D835,939 | S | 12/2018 | Yee et al. | |
| D839,044 | S | 1/2019 | Potter et al. | |
| D848,787 | S | 5/2019 | Tatsukawa et al. | |
| D853,181 | S | 7/2019 | Stanton | |
| D853,784 | S | 7/2019 | Wu | |
| D865,457 | S | 11/2019 | Kotani | |
| D869,230 | S | 12/2019 | Hao | |
| D870,509 | S | 12/2019 | Bo | |
| D897,157 | S | 9/2020 | McCabe et al. | |
| D903,406 | S | 12/2020 | McCabe et al. | |
| D907,960 | S | 1/2021 | McCabe et al. | |
| 2004/0069783 | A1 * | 4/2004 | Chen | A47G 19/2266 215/388 |
| 2006/0016776 | A1 | 1/2006 | Barre et al. | |
| 2006/0186077 | A1 | 8/2006 | Robinson | |
| 2009/0242564 | A1 | 10/2009 | Danks et al. | |
| 2011/0089059 | A1 | 4/2011 | Lane et al. | |
| 2012/0312832 | A1 | 12/2012 | Lane | |
| 2013/0220966 | A1 * | 8/2013 | Lane | A45F 3/16 215/228 |
| 2013/0319966 | A1 | 12/2013 | Lane | |
| 2014/0339177 | A1 | 11/2014 | Lane | |
| 2015/0173539 | A1 * | 6/2015 | Mason | B65D 77/283 220/715 |
| 2015/0282654 | A1 | 10/2015 | Kurabe et al. | |
| 2017/0208974 | A1 * | 7/2017 | Zhang | B65D 47/0857 |
| 2017/0297785 | A1 | 10/2017 | Maruyama et al. | |
| 2020/0010250 | A1 * | 1/2020 | Herling | B65D 47/066 |

OTHER PUBLICATIONS

Kor, "Vida Bottle—25oz," accessed on-line at: https://waterbottles.com/kor-vida-bottle-25-oz (available at least as early as Feb. 22, 2019).

Thermos, "Hydration Bottle with Rotating Intake Meter, 24oz," accessed on-line at: https://www.thermos.com/genuine-thermos-brand-hydration-bottle-with-rotating-intake-meter-24oz.html (available at least as early as Feb. 22, 2019).

Thermos, "Shaker Bottle with Integrated Mixer, 24oz," accessed on-line at: https://www.thermos.com/genuine-thermos-brand-shaker-bottle-with-integrated-mixer-24oz-clear-green-accents.html (available at least as early as Feb. 22, 2019).

Tervis, "Custom Water Bottle," accessed on-line at: https://www.tervis.com/turtle-sunset-stainless-steel-24oz-stainless-water-bottle-1362572.html (available at least as early as Feb. 22, 2019).

Swell, "Bottles," accessed on-line at: https://www.swell.com/shop/swell/bottles/ (available at least as early as Feb. 22, 2019).

Tritan, "32 oz Soft Straw Plastic Water Bottle," accessed on-line at: http://www.pogogear.com/32oz-tritan-straw (available at least as early as Feb. 22, 2019).

Tritan, "32oz Chug Plastic Water Bottle," accessed on-line at: http://www.pogogear.com/32oz-tritan-chug (available at least as early as Feb. 22, 2019).

Tritan, "18oz Chug Plastic Water Bottle," accessed on-line at: http://www.pogogear.com/18oz-tritan-chug (available at least as early as Feb. 22, 2019).

Ello, "chi 24oz BPA-Free Tritan Plastic Water Bottle," accessed on-line at: https://www.elloproducts.com/water-bottles/chi-24oz-plastic-water-bottle (available at least as early as Feb. 22, 2019).

Ello, "Dash 16oz 2pk Tritan Plastic Water Bottles," accessed on-line at: https://www.elloproducts.com/kids/dash-16oz-tritan-plastic-water-bottle (available at least as early as Feb. 22, 2019).

Ello, "Cru Stemless Wine glass Set with Silicone Protection," accessed on-line at: https://www.elloproducts.com/tumblers/cru-stemless-wine-glass-set-with-silicone-protection (available at least as early as Feb. 22, 2019).

Aladdin, "Water Bottle," (1 page) (available at least as early as Feb. 22, 2019).

(56) References Cited

OTHER PUBLICATIONS

Ello, "Elsie 22oz Glass Water Bottle," accessed on-line at: https://www.elloproducts.com/water-bottles/elsie-22oz-glass-water-bottle (available at least as early as Feb. 22, 2019).
Ello, "Beacon 24oz Vacuum Insulated Stainless Tumbler," accessed on-line at: https://www.elloproducts.com/tumblers/beacon-24oz-vacuum-insulated-stainless-tumbler (available at least as early as Feb. 22, 2019).
Ello, "Rise 12oz Vacuum Insulated Stainless Steel Tumbler with Optional Straw," accessed on-line at: https://www.elloproducts.com/kids/rise-12oz-vacuum-insulated-stainless-steel-tumbler (available at least as early as Feb. 22, 2019).
Ello, "Hammertime 18oz Stainless Steel Travel Mug," accessed on-line at: https://www.elloproducts.com/travel-mugs/hammertime-18oz-vacuum-insulated-stainless-steel-travel-mug (available at least as early as Feb. 22, 2019).
Ello, "Pure 20oz Glass Water Bottle," accessed on-line at: https://www.elloproducts.com/water-bottles/pure-20oz-glass-water-bottle (available at least as early as Feb. 22, 2019).
Ello, "Max 12oz Vacuum-Insulated Stainless Steel Kids Water Bottle," accessed on-line at: https://www.elloproducts.com/kids/max-12oz-vacuum-insulated-stainless-steel-kids-water-bottle (available at least as early as Feb. 22, 2019).
Allo, "Syndicate 20oz Glass Water Bottle," accessed on-line at: https://www.elloproducts.com/water-bottles/syndicate-20oz-glass-water-bottle (available at least as early as Feb. 22, 2019).
Mason, "Glass Jar," (1 page) (available at least as early as Feb. 22, 2019).
Camelbak, "Eddy+ 1L Bottle," accessed on-line at: https://www.camelbak.com/en/bottles/R02056-Eddy_75L_2019?color=6bbd0584f3a64b0eb30d406f7e03797e (available at least as early as Feb. 22, 2019).
Contigo, "Autoseal West Loop 2.0 Stainless," accessed on-line at: https://www.gocontigo.com/20-oz-autoseal-west-loop-stainless-travel-mug-with-easy-clean-lid.html (available at least as early as Feb. 22, 2019).
Contigo, "Autospout Straw Striker Chill," accessed on-line at: https://www.gocontigo.com/14-oz-autospout-striker-kids-water-bottle.html (available at least as early as Feb. 22, 2019).
Zojirushi, "Travel Mug SM-YAE48," accessed on-line at: https://www.zojirushi.com/app/product/smyae (available at least as early as Feb. 22, 2019).
Zojirushi, "Stainless Mug SM-KC3648," accessed on-line at: https://www.zojirushi.com/app/product/smkc (available at least as early as Feb. 22, 2019).
Zojirushi, "Stainless Bottle SJ-JS10," accessed on-lien at: https://www.zojirushi.com/app/product/sjjs (available at least as early as Feb. 22, 2019).
Zojirushi, "Flip-and-Go Stainless Mug SM-QHE48/60," accessed on-line at: https://www.zojirushi.com/app/product/smqhe (available at least as early as Feb. 22, 2019).
Zojirushi, "Stainless Mug SM-TAE48SA, Ichimatsu Collection," accessed on-line at: https://www.zojirushi.com/app/product/smtae (available at least as early as Feb. 22, 2019).
Zojirushi, "Stainless Mug SM-TA36/48/60," accessed on-line at: https://www.zojirushi.com/app/product/smta (available at least as early as Feb. 22, 2019).
Zojirushi, "Stainless Mug SM-SE36/48/60," accessed on-line at: https://www.zojirushi.com/app/product/smse (available at least as early as Feb. 22, 2019).
Zojirushi, "Stainless Mug SM-SD36/48/60," accessed on-line at: https://www.zojirushi.com/app/product/smsd (available at least as early as Feb. 22, 2019).
Zojirushi, "Stainless Mug SM-SHE48/60," accessed on-line at: https://www.zojirushi.com/app/product/smshe (available at least as early as Feb. 22, 2019).
Zojirushi, "Stainless Mug SM-KHE36/48," accessed on-line at: https://www.zojirushi.com/app/product/smkhe (available at least as early as Feb. 22, 2019).
Zojirushi, "Stainless Mug SM-SC36/48/60" accessed on-line at: https://www.zojirushi.com/app/product/smsc (available at least as early as Feb. 22, 2019).
Zojirushi, "Stainless Mug SM-KC36/48," accessed on-line at: https://www.zojirushi.com/app/product/smkc (available at east as early as Feb. 22, 2019).
Zojirushi, "Stainless Mug SM-PC20/30," accessed on-line at: https://www.zojirushi.com/app/product/smpc (available at east as early as Feb. 22, 2019).
Zojirushi, "Stainless Mug SM-PB30/34," accessed on-line at: https://www.zojirushi.com/app/product/smpb (available at east as early as Feb. 22, 2019).
Migo, "Enjoy Sport Water Bottle," accessed on-line at: https://www.pinterest.ru/pin/12666442685646757/ (available at least as early as Feb. 22, 2019).
Coleman, "Switch SS," accessed on-line at: https://www.coleman.com/all-camp-kitchen/drinkware/switch-ss/col_2038485_pr/COL_2038485 (available at least as early as Feb. 22, 2019).
Corkcicle, "Classic Arctican," accessed on-line at: https://corkcicle.com/products/classic-arctican?variant=475182759951 (available at least as early as Feb. 22, 2019).
Ello, "Reflext Beverage Container," (1 page) (available at least as early as Feb. 22, 2019).

* cited by examiner

SOFT STRAW LID FOR BEVERAGE CONTAINER

CROSS-REFERENCE TO RELATED APPLICATIONS

This application claims the benefit of U.S. Provisional Patent Application No. 62/903,175 filed Sep. 20, 2019, which is expressly incorporated herein by reference and made a part hereof.

FEDERALLY SPONSORED RESEARCH OR DEVELOPMENT

Not Applicable.

TECHNICAL FIELD

The present disclosure relates generally to lids for beverage containers, and more specifically to a soft straw lid for a beverage container.

BACKGROUND

Beverage containers and lids for beverage containers are well known in the art. While such beverage containers and lids according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to a lid assembly for a beverage container, wherein the lid assembly has a lid base, a lid dome and a mouthpiece.

The disclosed subject technology further relates to a lid assembly for a beverage container, comprising: a lid base; a pliable mouthpiece connected to the lid base, the mouthpiece having a first end distal the lid base, a second end that is adapted to receive a straw that is located within the beverage container, a drink aperture extending through the mouthpiece from the first end to the second end thereof, and the first end of the mouthpiece having a generally flat surface that is provided in a plane at an angle to the top surface of the lid base; and, a lid dome pivotally connected to the lid base, the lid dome pivoting between an open position and a closed position, the lid dome having a top wall and a sidewall extending therefrom, wherein the lid dome has a protrusion that extends from an inner surface of the top wall of the lid dome, wherein the protrusion has a seal surface at an angle to the top wall that operates to seal against the first end of the mouthpiece to close the drink aperture when the lid dome is in the closed position.

The disclosed subject technology further relates to a lid assembly for a beverage container, comprising: a lid base having a top surface and a sidewall extending downwardly therefrom, the lid base having a mouthpiece aperture and a vent aperture; a pliable mouthpiece connected to the lid base adjacent the mouthpiece aperture, the mouthpiece being curved toward a front of the beverage container adjacent a first end of the mouthpiece, the mouthpiece having a second end that is adapted to receive a straw that is located within the beverage container, the mouthpiece having a groove between the first end and the second end to assist in seating the mouthpiece to the lid base, a drink aperture extending through the mouthpiece from the first end to the second end thereof, and the first end of the mouthpiece having a generally flat surface that is provided in a plane at an angle to the top surface of the lid base; a lid dome pivotally connected to the lid base, the lid dome pivoting between an open position and a closed position, the lid dome having a top wall and a sidewall extending therefrom, and a tang extending downwardly from the sidewall, the tang having an aperture therethrough, wherein the lid dome has a protrusion that extends from an inner surface of the top wall of the lid dome, wherein the protrusion in the lid dome has a seal surface at an angle to the top wall that operates to seal against the first end of the mouthpiece to close the drink aperture when the lid dome is in the closed position; and, wherein the lid base has a fastening opening for receiving the tang of the lid dome, wherein the lid base has a pushbutton activator adjacent the fastening opening, the pushbutton activator having a projection that engages the aperture in the tang when the lid dome is in the closed position to secure the lid dome in the closed position, the projection releasing the tang when the pushbutton activator is pushed in by a user to allow the lid dome to be transitioned to the open position.

The disclosed subject technology further relates to a lid assembly for a beverage container, comprising: a lid base having a top surface and a sidewall extending downwardly therefrom; a mouthpiece having a first end distal the lid base, a second end that is adapted to receive a straw that is located within the beverage container, a drink aperture extending through the mouthpiece from the first end to the second end thereof, and the first end of the mouthpiece having a generally flat surface that is provided in a plane at an angle to the top surface of the lid base; a lid dome pivotally connected to the lid base, the lid dome pivoting between an open position and a closed position, the lid dome having a top wall and a sidewall extending therefrom, and a tang extending downwardly away from the sidewall in a direction opposite the top wall, wherein the lid dome has a protrusion that extends from an inner surface of the top wall of the lid dome, wherein the protrusion has a seal surface at an angle to the top wall that operates to seal against the first end of the mouthpiece to close the drink aperture when the lid dome is in the closed position, and wherein the protrusion generally mates with and is generally seated against the first end of the mouthpiece when the lid dome is in the closed position; and, wherein the lid base has a fastening opening for receiving the tang of the lid dome, wherein the lid base has a pushbutton activator adjacent the fastening opening, wherein the pushbutton activator engages the tang when the lid dome is in the closed position to secure the lid dome in the closed position, and wherein the pushbutton activator releases the tang when the pushbutton activator is pushed in by a user to allow the lid dome to be transitioned to the open position.

The disclosed subject technology further relates to a lid assembly for a beverage container, wherein the protrusion of the lid dome extends from an inner surface of the top wall of the lid dome at an angle to the top wall.

The disclosed subject technology further relates to a lid assembly for a beverage container, wherein the lid dome has a tang extending downwardly from the sidewall in a direction opposite the top wall, and wherein the tang has an aperture therethrough.

The disclosed subject technology further relates to a lid assembly for a beverage container, wherein the lid base has a fastening opening for receiving the tang of the lid dome, and a pushbutton activator, and wherein the pushbutton activator engages the aperture in the tang when the lid dome is in the closed position.

The disclosed subject technology further relates to a lid assembly for a beverage container, wherein the pushbutton activator has a projection that engages the aperture in the tang when the lid dome is in the closed position to secure the lid dome in the closed position, and wherein the projection releases the tang when the pushbutton activator is pushed in by a user to allow the lid dome to be transitioned to the open position.

The disclosed subject technology further relates to a lid assembly for a beverage container, further comprising a spring member connected to the lid dome to bias the lid dome to the open position.

The disclosed subject technology further relates to a lid assembly for a beverage container, wherein the lid base has a top wall, a sidewall, and a step between the top wall and the sidewall for seating the sidewall of the lid dome.

The disclosed subject technology further relates to a lid assembly for a beverage container, further comprising a lock member that transitions between a lock position and an unlock position, and wherein the lid base has a lock aperture to provide access to the lock member.

The disclosed subject technology further relates to a lid assembly for a beverage container, wherein the lock member moves within an annular opening in the lid base from the lock position to the unlock position, and wherein the lock member engages a pushbutton activator in the lock position to prevent the pushbutton activator from being pushed in to release the lid dome.

The disclosed subject technology further relates to a lid assembly for a beverage container, wherein the top wall of the lid dome extends at an angle to a top surface of the lid base and is transverse to the seal surface of the lid dome.

The disclosed subject technology further relates to a lid assembly for a beverage container, wherein the shape of the seal surface of the protrusion is generally elliptical, and wherein the mouthpiece at the first end thereof is generally elliptical.

The disclosed subject technology further relates to a lid assembly for a beverage container, wherein the lid base and the lid dome are made of a generally hard rigid plastic, and wherein the mouthpiece is made of a pliable material.

The disclosed subject technology further relates to a lid assembly for a beverage container, further comprising a lock member that moves within an annular opening in the lid base from a lock position to an unlock position, wherein the lid base has a lock aperture to provide access to the lock member, and wherein the lock member engages the pushbutton activator in the lock position to prevent the pushbutton activator from being pushed in to release the lid dome.

The disclosed subject technology further relates to a lid assembly for a beverage container, wherein the tang has an opening, and wherein pushbutton activator has a projection that engages an opening in the tang when the lid dome is in the closed position to releasably secure the lid dome in the closed position.

The disclosed subject technology further relates to a lid assembly for a beverage container, wherein the mouthpiece has a slightly arced shape and is curved toward a front of the beverage container.

The disclosed subject technology further relates to a lid assembly for a beverage container, wherein the lid dome compresses the mouthpiece in the closed position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
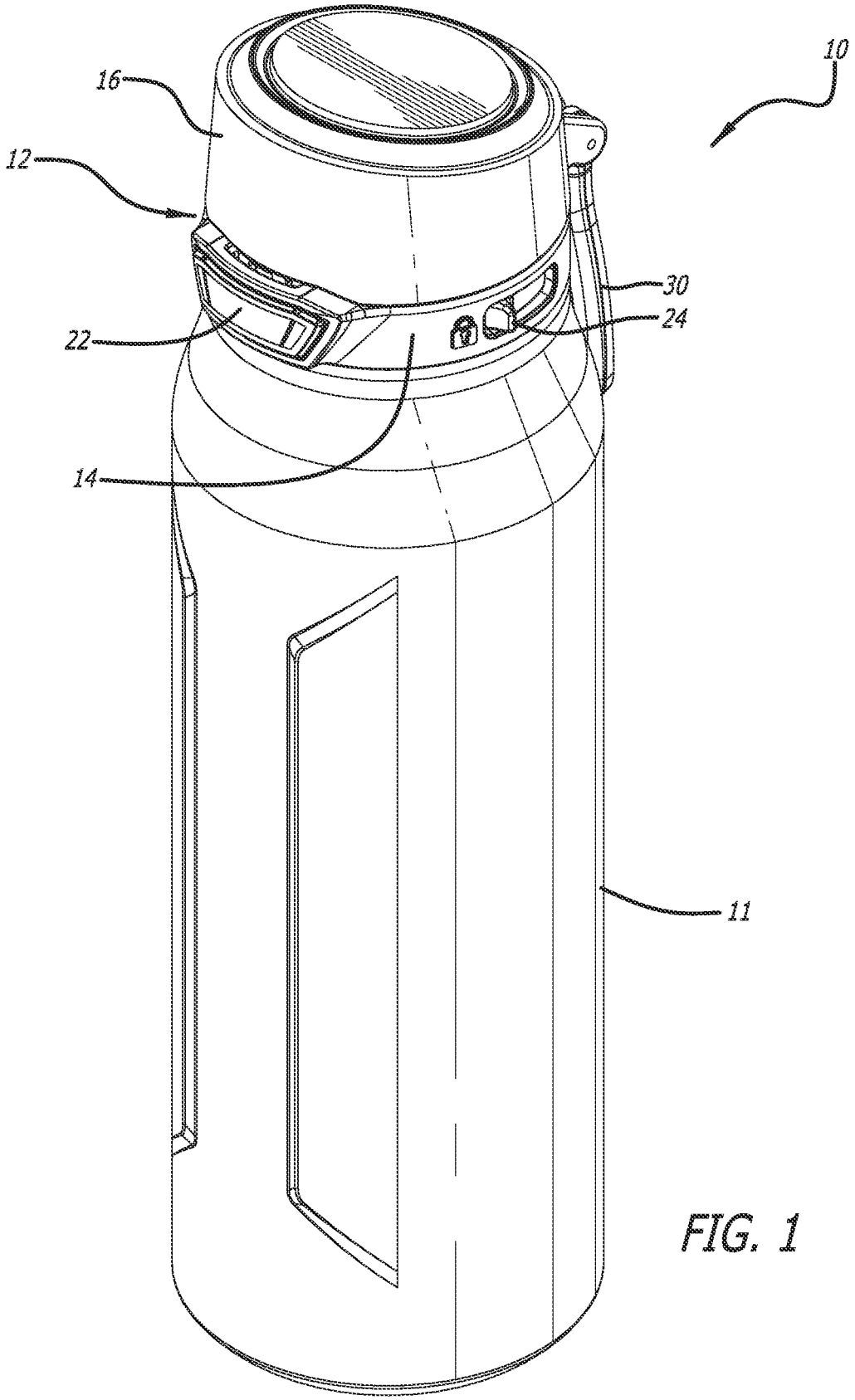
FIG. 1 illustrates a top perspective view of a beverage container having a soft straw lid assembly according to one embodiment.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Referring now to the figures, and initially to FIG. 1, a beverage container 10 is illustrated. In various embodiments the beverage container 10 includes a container body 11 and a soft straw lid assembly 12, as shown in FIGS. 2-5. Preferably, the soft straw lid assembly 12 is removably connected to the container body 11.

Figure 3:
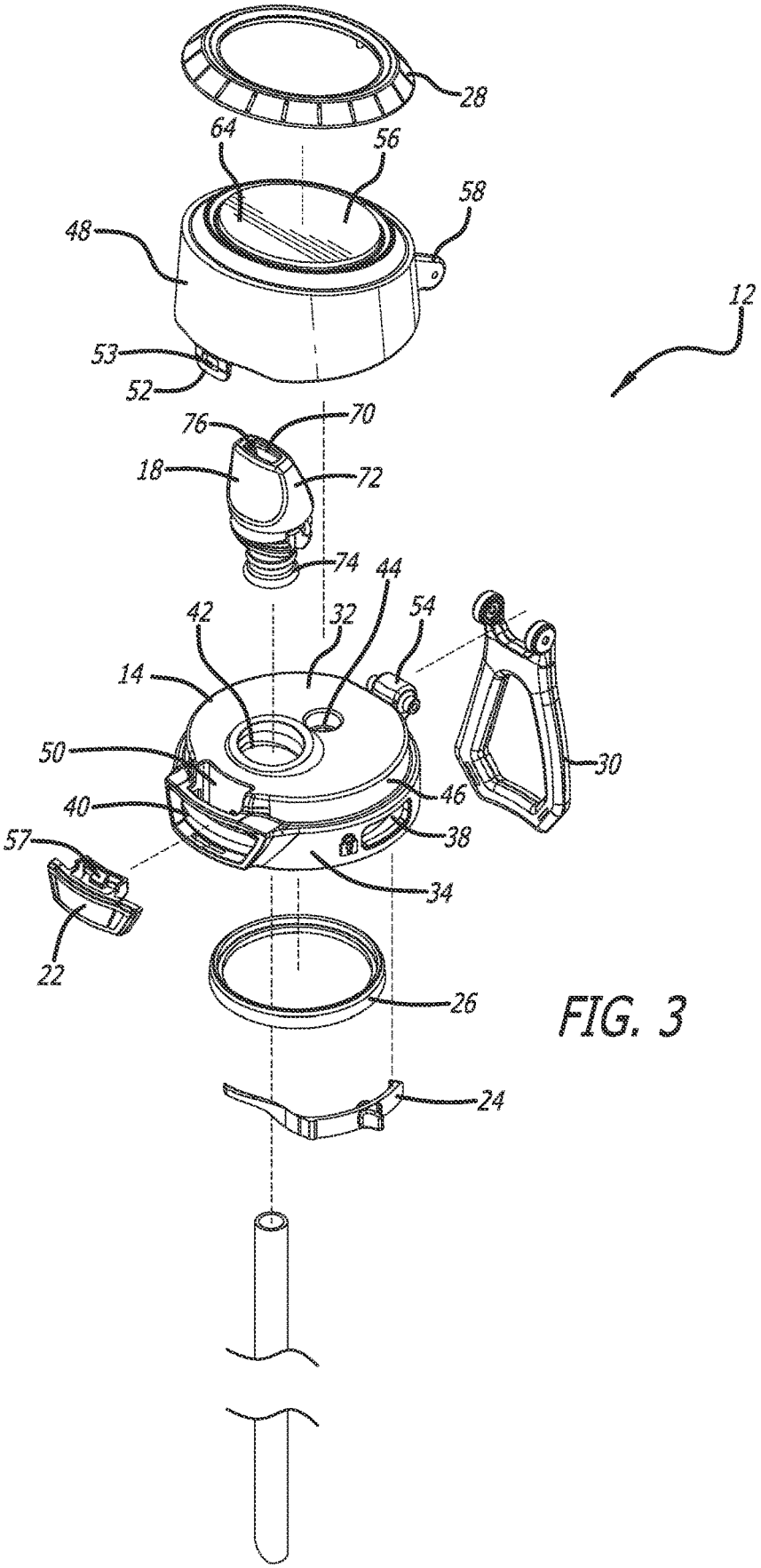
FIG. 3 illustrates an exploded perspective view of the soft straw lid assembly of FIG. 2.

In one embodiment, as best shown in FIG. 3, the soft straw lid assembly 12 comprises a lid base 14, a lid dome 16 pivotally connected to the lid base 14, a mouthpiece 18 connected to the lid base 14, a straw 20, a pushbutton activator 22, a lock member 24, and a seal 26. Additionally, in one embodiment, the lid assembly 12 may also include a dome overmold 28 and a carry loop 30.

Figure 4:
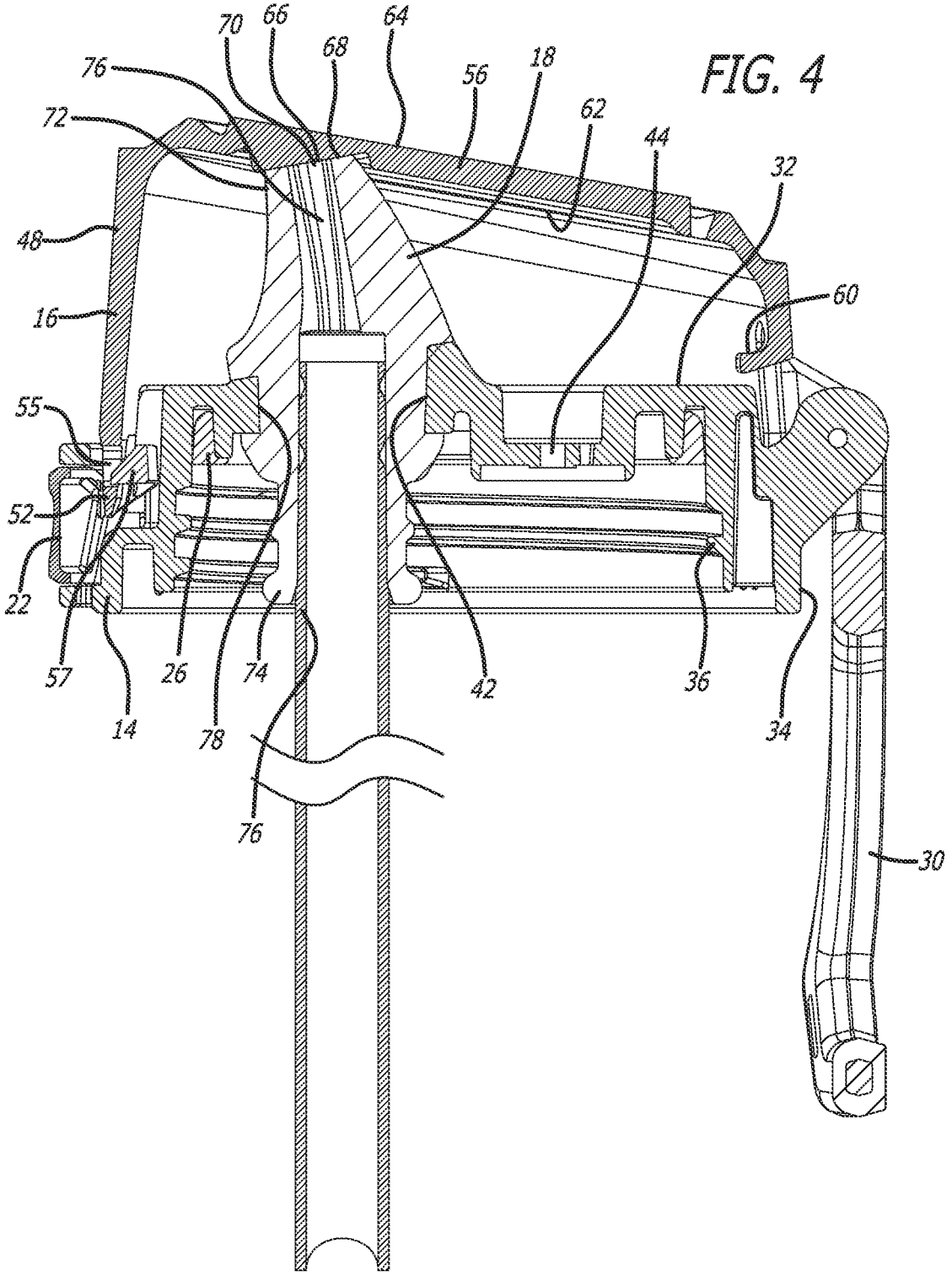
FIG. 4 illustrates a cross-sectional side view of the soft straw lid assembly of FIG. 2 with the lid in the closed position.

The lid base 14 generally comprises a housing for securing the lid assembly 12 to the container body 11, as well as for pivotally securing the lid dome 16 thereto and for securing the mouthpiece 18 thereto. In one embodiment, the lid base 14 has a top wall or top surface 32 and a sidewall 34 extending downwardly therefrom. The lid base 14 also has a mating member 36, such as threads 36, for removably securing the lid base 14 to the container body 11. The seal 26, such as an annular gasket or o-ring, is preferably provided adjacent the threads 36 of the lid base 14 as shown in FIGS. 3 and 4 for sealing the connection between the lid assembly 12 and the container body 11.

In one embodiment, the sidewall 34 of the lid base 14 has a lock aperture 38 for providing access to the lock member 24 and for allowing the lock member 24 to be manipulated by the user between a lock position and an unlocked position.

Further, in one embodiment, the sidewall 34 of the lid base 14 has a receiver 40 for receiving and securing the pushbutton activator 22. The lock member 24 moves or rotates within an annular opening in the lid base 14 from the locked position to the unlock position to prevent the pushbutton activator 22 from disengaging from the lid dome 16 when the lock member 24 is in the locked position. Thus, the lock member 24 engages the pushbutton activator 22 in the lock position to prevent the pushbutton activator 22 from being pushed in by the user, and thus assists in preventing the lid dome 16 from being released from the closed position on the lid base 14 as shown in FIG. 1 when the lock member 24 is in the locked position.

In one embodiment, the top surface or top wall 32 of the lid base 14 has a mouthpiece aperture 42 and a vent aperture 44. Additionally, there is a step 46 between the top wall 32 and the sidewall 34 of the lid base 14 for seating the sidewall 48 of the lid dome 16.

The lid base 14 may also have a fastening opening 50 for receiving a tang 52 of the lid dome 16. Further, in one embodiment the lid base 14 has a receiver 54 for pivotally receiving the lid dome 16. The receiver 54 is preferably opposite the fastening opening 50.

Figure 2:
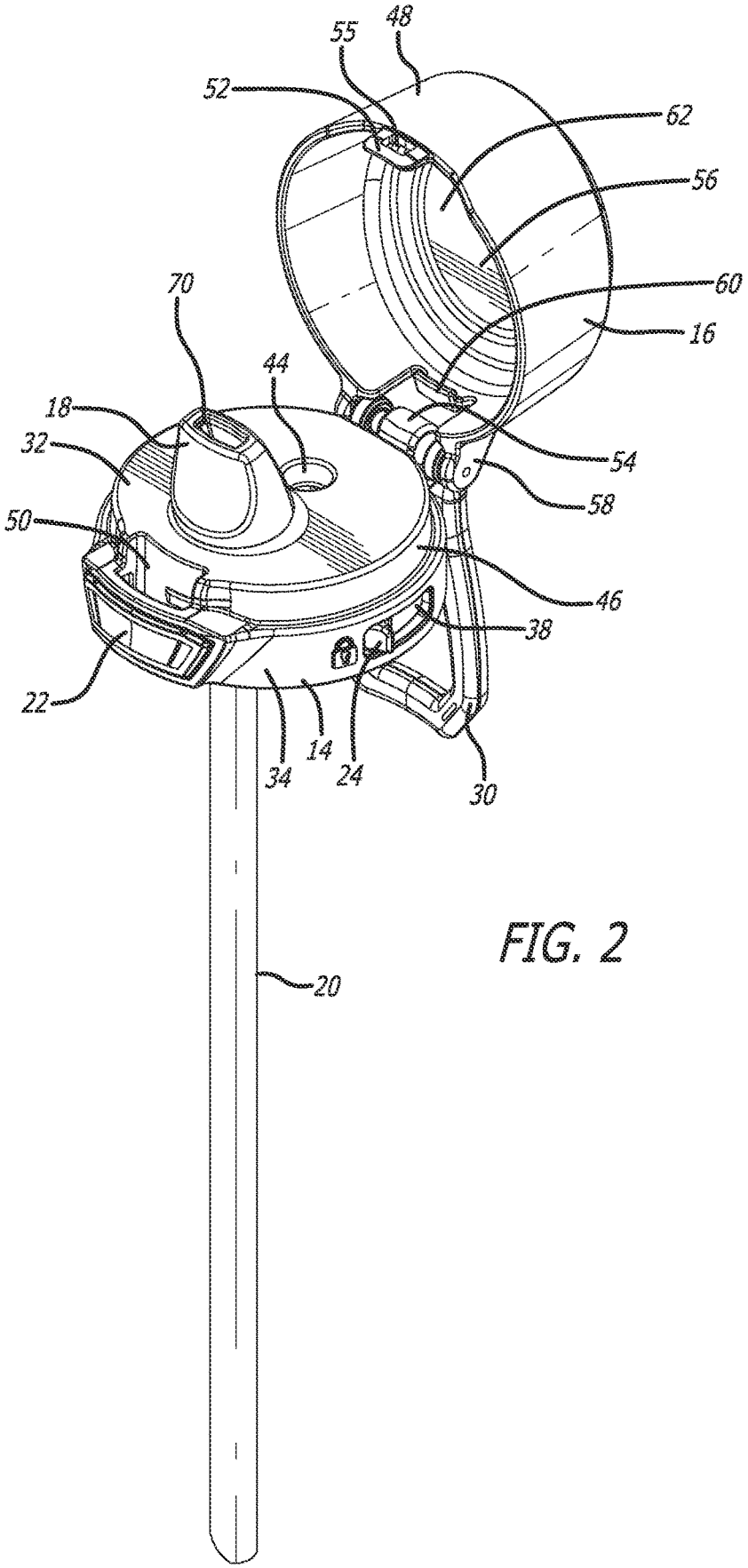
FIG. 2 illustrates a front perspective view of the soft straw lid assembly of FIG. 1 with the lid in the open position.

As shown in FIGS. 2-4, the lid dome 16 has a top wall 56 and a sidewall 48 extending therefrom. The tang 52 of the lid dome 16 preferably extends downwardly away from sidewall 48 in a direction opposite the top wall 56 of the lid dome 16. In one embodiment, the tang 52 has an aperture 55 therethrough. The lid dome 16 also has a mating member 58 extending from the sidewall 48 opposite the tang 52. The mating member 58 pivotally engages the receiver 54 of the lid base 14 allowing the lid dome 16 to be pivoted between the open position, shown in FIG. 2, and the closed position, shown in FIGS. 3 and 4, for opening and closing the lid dome 16. Additionally, a spring member (now shown), such as a rubber o-ring, may be provided between receiver 54 of the lid base 14 and a flange 60 extending radially inwardly from the sidewall 48 of the lid dome 16 to bias the lid dome 16 to the open position as shown in FIG. 2.

To close the lid dome 16 the lid dome 16 is rotated down toward the front of the lid base 14. In the closed position the tang 52 of the lid dome 16 will pass through fastening opening 50 of the lid base 14 and engage the pushbutton activator 22 to retain the lid dome 16 in the closed position. The pushbutton activator 22 is provided adjacent the fastening opening 50. The pushbutton activator 22 has a projection 57 that engages the aperture 55 in the tang 52 when the lid dome 16 is in the closed position to secure the lid dome 16 in the closed position. To release the lid dome 16, if the lock member 24 is in the unlocked position, the operator pushes in the pushbutton activator 22 and the tang 52 will be released from the projection 57 of the pushbutton activator 22, and the spring member between the lid base 14 and the lid dome 16 will operate to rotate the lid dome 16 to the open position as shown in FIG. 2. However, if the lock member 24 is in the locked position, the user will be unable to push in the pushbutton activator 22 and therefore the tang 52 cannot be released from the pushbutton activator 22, which maintains the lid dome 16 locked in the closed position.

Figure 5:
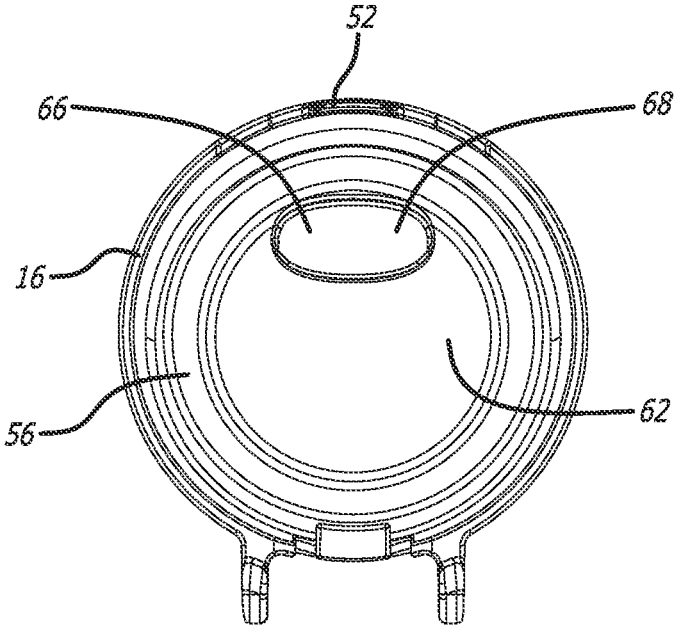
FIG. 5 illustrates a bottom plan view of the inside of the lid dome of the beverage container of FIG. 1.

In one embodiment, as shown in FIG. 4, the top wall 56 of the lid dome 16 is angled upwardly from the rear of the lid dome 16 to the front of the lid dome 16, and thus the top wall 56 of the lid dome 16 extends at an angle to the top surface 32 of the lid base 14 and is transverse to the seal surface 68 of the lid dome 16. The top wall 56 of the lid dome 16 has an interior surface 62 and an exterior surface 64. In one embodiment, a protrusion 66 extends from the interior surface 62 of the top wall 56 of the lid dome 16. As discussed herein, the protrusion 66 has a seal surface 68 at an angle to the top wall 56 that engages the mouthpiece 18 and operates to seal against the first end 72 of the mouthpiece 18 to close the opening 70 to the drink aperture 76 of the mouthpiece 18 when the lid dome 16 is in the closed position as shown in FIG. 4. The seal surface 68 may be generally elliptical in shape as shown in FIG. 5. Similarly, the first end 72 of the mouthpiece 18 may be similarly generally elliptical in shape.

As shown in FIGS. 2-5, in one embodiment, the mouthpiece 18 of the lid assembly 12 is a pliable member that has a first end 72 distal the lid base 14 and a second end 74. The mouthpiece 18 may be made of silicone. The first end 72 of the mouthpiece 18 may have a generally flat surface that is provided in a plane at an angle to the top surface 32 of the lid base 14. The mouthpiece 18 also has a drink aperture 76 extending therethrough from the first end 72 to the second end 74. Additionally, as shown in FIG. 4, the mouthpiece 18 may have a groove 78 between the first end 72 and the second end 74 to assist in seating the mouthpiece 18 to the lid base 14 and for securing the mouthpiece 18 within the mouthpiece aperture 42 of the lid base 14. The second end 72 is adapted to receive the straw 20. In one embodiment the straw 20 is received within the aperture 76 of the mouthpiece 18 at the second end 74 of the mouthpiece 18. Additionally, aperture 76 at the second end 74 may have a cylindrical shape to receive the straw 20 at the second end 74, whereas the aperture 76 at the first end 72 may have a generally rectangular or elliptical shape consistent with the shape of the mouthpiece 18 at the first end 72 thereof. Further, the mouthpiece 18 may be angled or curved toward the front of the lid assembly 12, including adjacent a first end 72 of the mouthpiece 18, to make it easier for a user to drink therefrom.

In one embodiment, the seal surface 68 of the protrusion 66 on the interior surface 62 of the top wall 56 of the lid dome 16 operates as a seal for the first end 72 of the mouthpiece 18 and for the opening 70 of the aperture 76 of the mouthpiece 18 when the lid dome 16 is in the closed position. The lid dome 16 and lid base 14 are preferably made of a rigid plastic, such as polyethylene. The protrusion 66 and seal surface 68 are integral with the lid dome 16, and therefore are similarly made of a rigid plastic. With reference to FIG. 4, the seal surface 68 of the protrusion 66 extends away from the top wall 56 and at an angle to the top wall 56 of the lid dome 16. Similarly, the first end 72 of the mouthpiece 18 has a mating angular orientation to the seal surface 68 when the lid dome 16 is in the closed position. Therefore, when the lid dome 16 is transitioned to the closed position with respect to the lid base 14, the seal surface 68 of the protrusion 66 will engage the first end 72 of the mouthpiece 18 to provide a stopper or seal for the opening 70 of the aperture 76 of the mouthpiece 18 to prevent liquid from passing out of the aperture 76 of the mouthpiece 18 when the lid dome 16 is in the closed position. In one embodiment, the lid dome 16 slightly compresses the mouthpiece 18 when the lid dome 16 is in the closed position.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A lid assembly for a beverage container, comprising:

a lid base having a top surface and a sidewall extending downwardly therefrom, the lid base having a mouthpiece aperture and a vent aperture;

a pliable mouthpiece connected to the lid base adjacent the mouthpiece aperture, the mouthpiece being curved toward a front of the beverage container adjacent a first end of the mouthpiece, the mouthpiece having a second end that is adapted to receive a straw that is located within the beverage container, the mouthpiece having a groove between the first end and the second end to assist in seating the mouthpiece to the lid base, a drink aperture extending through the mouthpiece from the first end to the second end thereof, and the first end of the mouthpiece having a flat surface that is provided in a plane at an angle to the top surface of the lid base;

a lid dome pivotally connected to the lid base, the lid dome pivoting between an open position and a closed position, the lid dome having a top wall and a sidewall extending therefrom, and a tang extending downwardly from the sidewall, the tang having an aperture therethrough, wherein the lid dome has a protrusion that extends from an inner surface of the top wall of the lid dome, wherein the protrusion in the lid dome has a seal surface at an angle to the top wall that operates to seal against the first end of the mouthpiece to close the drink aperture when the lid dome is in the closed position; and, wherein the lid base has a fastening opening for receiving the tang of the lid dome, wherein the lid base has a pushbutton activator adjacent the fastening opening, the pushbutton activator having a projection that engages the aperture in the tang when the lid dome is in the closed position to secure the lid dome in the closed position, the projection releasing the tang when the pushbutton activator is pushed in by a user to allow the lid dome to be transitioned to the open position.

2. The lid assembly of claim 1, wherein the top wall of the lid dome extends at an angle to the top surface of the lid base and is transverse to the seal surface of the lid dome.

3. The lid assembly of claim 1, wherein the seal surface of the protrusion is elliptical, and wherein the mouthpiece at the first end thereof is elliptical.

4. The lid assembly of claim 1, further comprising a lock member that moves within an annular opening in the lid base from a lock position to an unlock position, wherein the lid base has a lock aperture to provide access to the lock member, and wherein the lock member engages the pushbutton activator in the lock position to prevent the pushbutton activator from being pushed in to release the lid dome.

5. A lid assembly for a beverage container, comprising:

a lid base;

a pliable mouthpiece connected to the lid base, the mouthpiece having a first end distal the lid base, a second end that is adapted to receive a straw that is located within the beverage container, a drink aperture extending through the mouthpiece from the first end to the second end thereof, and the first end of the mouthpiece having a flat surface that is provided in a plane at an angle to the top surface of the lid base; and, a lid dome pivotally connected to the lid base, the lid dome pivoting between an open position and a closed position, the lid dome having a top wall and a sidewall extending therefrom, wherein the lid dome has a protrusion that extends from an inner surface of the top wall of the lid dome, wherein the protrusion has a seal surface at an angle to the top wall that operates to seal against the first end of the mouthpiece to close the drink aperture when the lid dome is in the closed position.

6. The lid assembly of claim 5, wherein the protrusion of the lid dome extends from an inner surface of the top wall of the lid dome at an angle to the top wall.

7. The lid assembly of claim 5, wherein the lid dome has a tang extending downwardly from the sidewall in a direction opposite the top wall, and wherein the tang has an aperture therethrough.

8. The lid assembly of claim 7, wherein the lid base has a fastening opening for receiving the tang of the lid dome, and a pushbutton activator, and wherein the pushbutton activator engages the aperture in the tang when the lid dome is in the closed position.

9. The lid assembly of claim 8, wherein the pushbutton activator has a projection that engages the aperture in the tang when the lid dome is in the closed position to secure the lid dome in the closed position, and wherein the projection releases the tang when the pushbutton activator is pushed in by a user to allow the lid dome to be transitioned to the open position.

10. The lid assembly of claim 5, further comprising a spring member connected to the lid dome to bias the lid dome to the open position.

11. The lid assembly of claim 5, wherein the lid base has a top wall, a sidewall, and a step between the top wall and the sidewall for seating the sidewall of the lid dome.

12. The lid assembly of claim 5, further comprising a lock member that transitions between a lock position and an unlock position, and wherein the lid base has a lock aperture to provide access to the lock member.

13. The lid assembly of claim 12, wherein the lock member moves within an annular opening in the lid base from the lock position to the unlock position, and wherein the lock member engages a pushbutton activator in the lock position to prevent the pushbutton activator from being pushed in to release the lid dome.

14. The lid assembly of claim 5, wherein the top wall of the lid dome extends at an angle to a top surface of the lid base.

15. The lid assembly of claim 5, wherein the shape of the seal surface of the protrusion is elliptical, and wherein the mouthpiece at the first end thereof is generally elliptical.

16. The lid assembly of claim 5, wherein the lid base and the lid dome are made of a hard rigid plastic, and wherein the mouthpiece is made of a pliable material.

17. A lid assembly for a beverage container, comprising:

a lid base having a top surface and a sidewall extending downwardly therefrom;

a mouthpiece having a first end distal the lid base, a second end that is adapted to receive a straw that is located within the beverage container, a drink aperture extending through the mouthpiece from the first end to the second end thereof, and the first end of the mouthpiece having a flat surface that is provided in a plane at an angle to the top surface of the lid base;

a lid dome pivotally connected to the lid base, the lid dome pivoting between an open position and a closed position, the lid dome having a top wall and a sidewall extending therefrom, and a tang extending downwardly away from the sidewall in a direction opposite the top wall, wherein the lid dome has a protrusion that extends from an inner surface of the top wall of the lid dome, wherein the protrusion has a seal surface at an angle to the top wall that operates to seal against the first end of the mouthpiece to close the drink aperture when the lid dome is in the closed position, and wherein the protrusion mates with and is seated against the first end of the mouthpiece when the lid dome is in the closed position; and, wherein the lid base has a fastening opening for receiving the tang of the lid dome, wherein the lid base has a pushbutton activator adjacent the fastening opening, wherein the pushbutton activator engages the tang when the lid dome is in the closed position to secure the lid dome in the closed position, and wherein the pushbutton activator releases the tang when the pushbutton activator is pushed in by a user to allow the lid dome to be transitioned to the open position.

18. The lid assembly of claim 17, wherein the tang has an opening, and wherein pushbutton activator has a projection that engages an opening in the tang when the lid dome is in the closed position to releasably secure the lid dome in the closed position.

19. The lid assembly of claim 17, wherein the mouthpiece has a slightly arced shape and is curved toward a front of the beverage container.

20. The lid assembly of claim 17, wherein the lid dome compresses the mouthpiece in the closed position.

* * * * *